United States Patent [19]

Marks

[11] 4,115,939

[45] Sep. 26, 1978

[54] BOTTLE WITH A MULTIPLE PART LABEL

[76] Inventor: Cedric Marks, 880 Fifth Ave., New York, N.Y. 10021

[21] Appl. No.: 729,172

[22] Filed: Oct. 4, 1976

[51] Int. Cl.[2] ..... G09F 3/00
[52] U.S. Cl. ..... 40/310; 40/2 R
[58] Field of Search ..... 40/310, 135, 2, 137

[56] References Cited

U.S. PATENT DOCUMENTS

| | | | |
|---|---|---|---|
| 635,098 | 10/1899 | Henckel | 40/310 |
| 2,305,890 | 12/1842 | Moore | 40/135 X |
| 2,810,978 | 10/1957 | Chapman | 40/310 |

FOREIGN PATENT DOCUMENTS

| | | | |
|---|---|---|---|
| 380,869 | 9/1932 | United Kingdom | 40/310 |

*Primary Examiner*—Louis G. Mancene
*Assistant Examiner*—Wenceslao J. Contreras
*Attorney, Agent, or Firm*—Posnack, Roberts, Cohen & Spiecens

[57] ABSTRACT

A package construction is provided in which a glass bottle containing a light-permeable liquid has front and rear label sections thereon to be viewed in cooperative relationship. The rearmost label has information thereon which is printed in distorted form in order to compensate for the optical distortion of the same due to refraction of the bottle and liquid therein. The front label section may be provided with a distorted opening through which the rear label section is viewed.

1 Claim, 5 Drawing Figures

FIG. 3
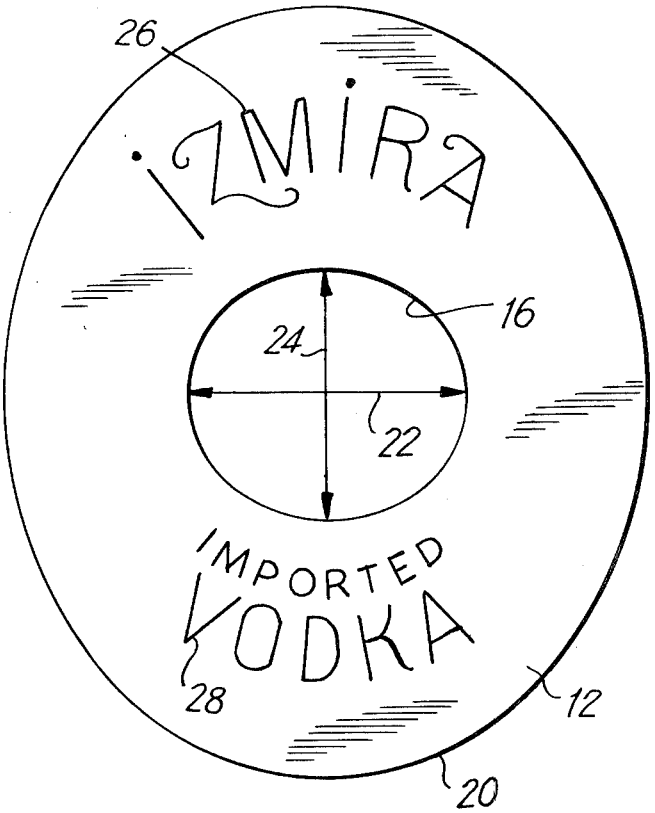
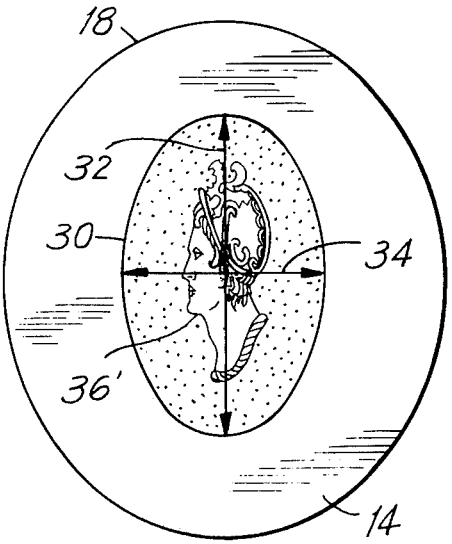
FIG. 5
FIG. 4
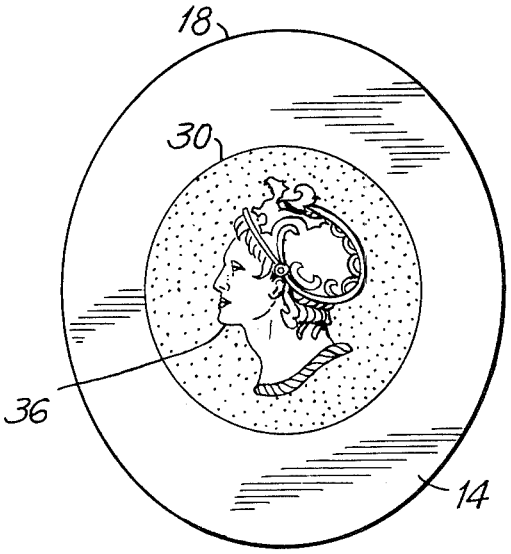

BOTTLE WITH A MULTIPLE PART LABEL

FIELD OF INVENTION

This invention relates to package constructions, label arrangements, and methods for labelling bottles containing transparent or translucent liquids.

BACKGROUND

Label arrangements are known in which label sections are disposed on opposite sides of a bottle in order to be viewed in cooperative relationship.

One such label arrangement is disclosed in U.S. Pat. No. 635,098 which issued to G. Henckel on Oct. 17, 1899. In the arrangement of this patent, a label is provided which is affixed to a transparent vessel containing a transparent substance. More particularly, there is provided a main label containing desired advertising material and affixed to one side of said vessel, the label being provided with a cutout portion. A secondary label is provided with further advertising material and is affixed to the opposite side of the vessel and is so arranged that the advertisement or printed matter thereon may be read through the cutout portion of the main label and through the transparent vessel and substance therein. This arrangement fails to make provision for the refraction inherent in the glass from which the vessel is fabricated as well as for the refraction of the transparent material contained therein.

Another example of a two-part label is disclosed in U.S. Pat. No. 2,305,890 which issued to J. H. Moore on Dec. 22, 1942. In the label arrangement disclosed in this patent, there is an article having a pair of spaced substantially parallel transparent faces on which labels are affixed constituting the background and foreground of an illustration, the foreground being superimposed against the background and cooperatively forming therewith a complete picture in stereoscopic relief. The bottle shown in this patent has parallel faces and, in any event, does not make provision for the refraction inherent in the glass forming the container or the refraction of the material accommodated within the container.

British Pat. No. 380,869 shows a label construction with a window through which may be viewed a diametrally opposed label portion having information thereon. This patent also fails to take into account the refraction of the container or material therein.

SUMMARY OF INVENTION

It is an object of the invention to provide an improved package construction.

It is a further object of the invention to provide an improved label arrangement for use in decorating package constructions and supplying information to the purchaser.

Yet another object of the invention is to provide an improved method for affixing labels to bottles and the like.

In achieving the above and other objects of the invention, there is provided a package construction comprising a bottle of light-permeable material, a light-permeable liquid in said bottle and front and rear label sections on opposed sides of said bottle to be viewed in cooperative relationship, at least one of said label sections including a field at least in part distorted to compensate for optical distortion of the rear label section due to refraction of the bottle and liquid.

The rear label section may have visually perceptible information thereon facing towards the front label section, said information being distorted to compensate for the aforesaid optical distortion.

The rear label section may further have visually perceptible information thereon facing away from the front label section and being devoid of the distortion of the first said visually perceptible information.

As a feature of the invention the front label section may be provided with an opening through which the rear label section is viewed, said bottle being generally cylindrical, the information in the field of the rear label section being compressed in lateral direction to compensate for optical distortion.

According to another feature, the opening in the front label section may be laterally expanded.

According to a specific embodiment of the invention, the opening in the front label section may be oval with a horizontal major axis and the field on the rear label may be oval with a vertical major axis.

According to another aspect of the invention, there is provided a label construction for a package arrangement which comprises a bottle of light-permeable material and a light-permeable liquid in said bottle, the label construction being substantially as mentioned hereinabove.

In accordance with still another aspect of the invention, there is provided a method of labelling a liquid containing bottle comprising placing rear and front label sections on opposite sides of said bottle such that the rear label section is viewed through the bottle and liquid and is distorted thereby, the invention contemplating the improvement which comprises compensating the distortion of at least part of the rear label section for reasons advanced hereinabove.

Other objects, features, and advantages of the invention will be apparent from the detailed description which follows hereinafter.

BRIEF DESCRIPTION OF THE DRAWING

In the drawing:

FIG. 3 is a view of the front label section employed in accordance with the invention on the bottle of FIGS. 1 and 2;

FIG. 4 is a view of the rear label section as it would appear if the information thereon were not distorted; and FIG. 5 is a view corresponding to FIG. 4 with the information thereon distorted in accordance with the invention.

DETAILED DESCRIPTION

As has been indicated above, there is provided in accordance with the invention a package construction comprising a bottle of light-permeable material, a light-permeable liquid in said bottle and front and rear label sections on opposed sides of said bottle to be viewed in cooperative relationship, at least one of said label sections including a field at least in part distorted to compensate for optical distortion of the rear label section due to refraction which is characteristic of the bottle and the liquid therein.

Figure 1:
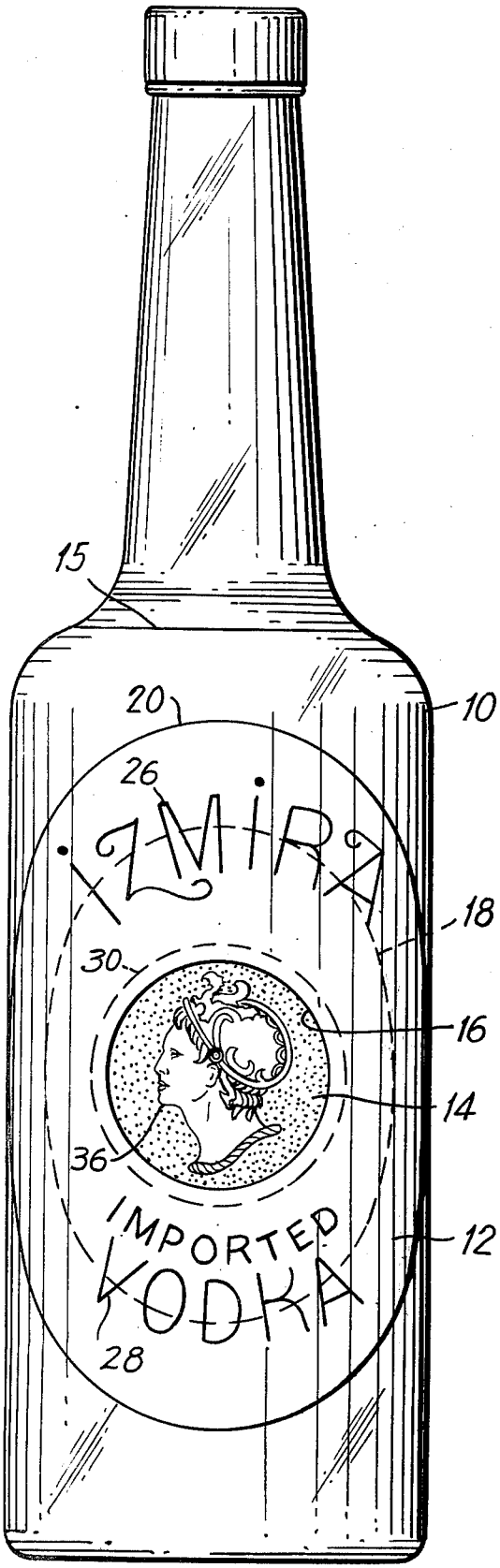
FIG. 1 is a front view of a bottle provided with a label arrangement in accordance with the invention.
Figure 2:
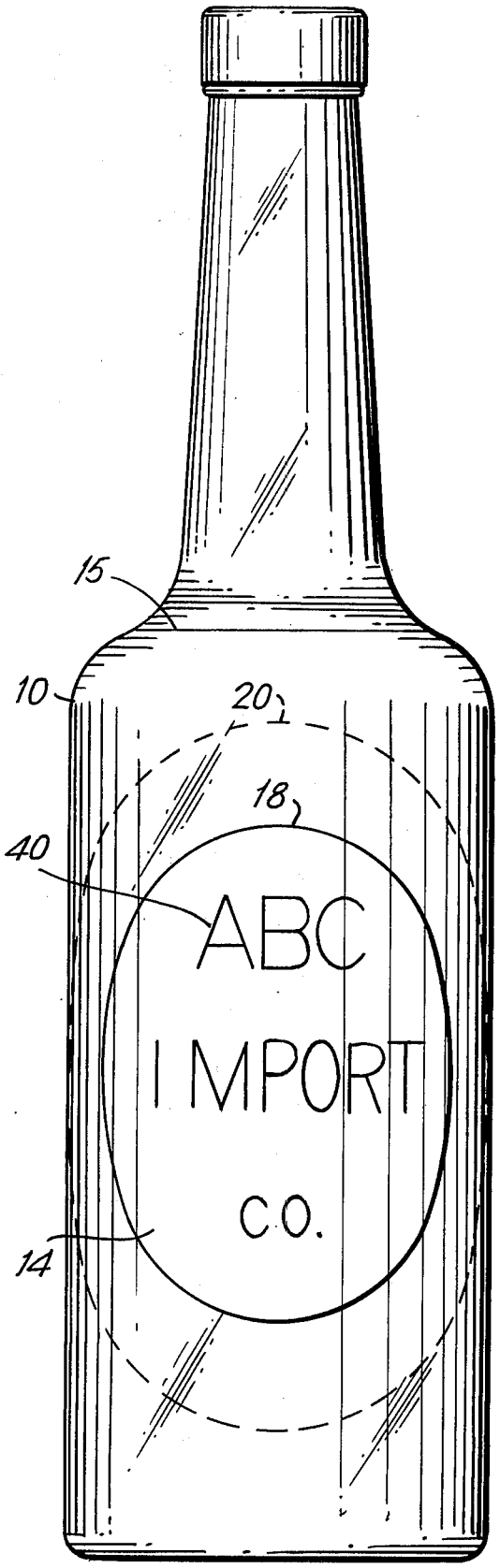
FIG. 2 is a rear view of the bottle of FIG. 1.

FIGS. 1 and 2 illustrate a bottle 10 which is provided with a label arrangement in accordance with the invention.

The front view illustrated in FIG. 2 shows the front label section 12 with the rear label section 14 partially visible therethrough. It will be noted that the information on the rear label section 14 is in relatively undistorted form, the information having been previously arranged as will be described hereinafter to account for the refraction characteristic of the material from which the bottle 10 is fabricated and of the material contained in the bottle.

The bottle 10 is in its main body portion generally and preferably of cylindrical form although the teachings of the invention are applicable as well to bottles of ovate form and other various complicated forms as well. The bottle 10 may be fabricated from transparent or translucent glass or plastic or other such materials as are suitable for holding the liquid 15 which is accommodated therein. The liquid 15 may be, for example, an alcoholic beverage or the like which is transparent or translucent and has a characteristic index of refraction as does the material from which the bottle is fabricated.

As appears in FIG. 1, the outer perimeter of the rear label section 14 exceeds the size of the opening 16 which is formed in the front label section 16. The perimeter of the rear label section is indicated at 18. Its form, as well as other forms relevant to the invention, will be described hereinafter. The outer periphery or perimeter of the front label section is indicated at 20. Its form will also be described hereinafter with reference to FIGS. 3–5.

With reference next to FIG. 3, it is seen that the outer periphery 20 of the front label section 12 is in the form of an oval or ellipse having a vertical major axis. The opening 16, however, is in the shape of an oval having a horizontal major axis 22 and a vertical minor axis 24. The major axis 22 is expanded by about 10 to 20% over the size which it would have if the opening 16 were to be circular. The purpose of this is to accommodate the curvature of the cylindrical portion of the bottle 10, so that when viewed the opening 16 gives a circular rather than oval appearance.

The information on the label 12 is indicated at 26 and 28 by way of example. This information can be printed in non-distorted form.

FIGS. 4 and 5 illustrate the rear label section 14. The outer periphery of the rear label section is indicated at 18 and, similar to outer periphery of the front label section, is of oval shape having a vertical major axis and a horizontal minor axis.

Within the periphery of the rear label section 14 is the field of information 30. This field is preferably compressed along its horizontal axis so that the field may be considered generally to be an oval or ellipse having a major axis indicated at 32 and a minor axis indicated at 34. The compression is in the order of 40 to 60% which is sufficient to accommodate the curvature of cylindrical bottles normally of a shape and size sufficient to accommodate a fluid quart.

The information contained within the field 30 is shown in undistorted form at 36 in FIG. 4. A prime has been added to the designation in FIG. 5 (36') in order to differentiate between the horizontally compressed information in FIG. 5 and the uncompressed or non-distorted information in FIG. 4. The information in FIG. 4 is as the information would normally appear with the label in flattened form and not applied to a bottle nor being viewed through the material from which the bottle is formed or through the liquid contained within the bottle. In FIG. 5, the compression of the information in horizontal direction accommodates the refraction of the glass or plastic of the bottle as well as the material contained within the bottle, so that the information 36' viewed through the bottle and its contents will appear as illustrated in FIGS. 1 and 4.

It will be appreciated that the index of refraction for the glass of the bottle as well as the contents thereof will differ from bottle to bottle according to the materials and shapes involved. The information and the field may be adequately compressed or distorted to compensate for the refraction characteristic of the bottle and liquid. This may be scientifically calculated according to equation, but is more readily determined by empirical determination using trial and error.

According to the method of the invention, there is contemplated an improvement in the method of labelling a liquid containing bottle which comprises placing rear and front label sections on opposite sides of the bottle such that the rear label section is viewed through the bottle and liquid and is distorted thereby. The improvement of the invention comprises compensating the distortion of at least part of the rear label section and, particularly, the information thereon in order to balance the effects of the distortion or refraction caused by viewing the rear label section through the bottle and the contents thereof.

The information appearing on the outer side of the rear label (i.e., that portion facing away from the front label) may be printed in non-distorted form. This information is indicated at 40 in FIG. 2. Accordingly, the outwardly facing information on the front and rear label sections may be printed in non-distorted form, whereas the information on the rear label section which is viewed through the contents of the bottle should be printed in distorted form.

For purposes of providing the information in distorted form, advantage can be taken of photographic techniques. For example, in doing the photographic work to convert the appearance of the head from that in FIG. 4 to that in FIG. 5, the original model such as appears in FIG. 4 can be aligned at a 45° angle relative to the lens of the camera employed. This will make for a somewhat greater distortion on one side of the head than on the other side of the head but when the distance from the camera lens is considered in comparing one side to the other, the distortion due to this differential will not affect the final result by a perceptible amount. The 45° degree angle will provide the required distortion or squeezing together of the head for the purposes indicated hereinabove.

In making reference hereinabove to printing, it is to be realized that no attempt is made to limit the application of the invention. Other forms of placing information and/or decorations on the labels may as well be employed. In referring to the field on the rear lable section, likewise no attempt is made to limit the scope of the invention inasmuch as the information thereon may constitute the field or the field may constitute the information and surrounding decorative section of the rear label section or the like.

There will now be obvious to those skilled in the art many modifications and variations of the constructions, arrangements, and methods set forth hereinabove. Such modifications and variations will not depart from the scope of the invention if defined by the following claims.

What is claimed is:

1. A package construction comprising a bottle of light-permeable material, a light-permeable liquid in said bottle, and front and rear label sections on opposed sides of said bottle to be viewed in cooperative relation, at least one of said label sections including a field at least in part distorted to compensate for optical distortion of the rear label section due to refraction of the bottle and liquid, the rear label section having visually perceptible information thereon facing towards the front label section, said information being distorted to compensate for said optical distortion, the front label section being provided with an opening through which the rear label section is viewed, said bottle being generally cylindrical, the information in the field of the rear label section being compressed in lateral direction to compensate for optical distortion, the opening being laterally expanded, the rear label section further having visually perceptible information thereon facing away from the front label section and being devoid of the distortion of the first said visually perceptible information; the information in the field of the rear label section being compressed by about 40–60%, said opening being laterally expanded by about 10–20%.

* * * * *